US010015575B2

(12) United States Patent
Pieklik et al.

(10) Patent No.: US 10,015,575 B2
(45) Date of Patent: Jul. 3, 2018

(54) SPEAKER ASSEMBLY

(71) Applicant: Poly-Planer Group, LLC, Hanover, MD (US)

(72) Inventors: William R. Pieklik, Baltimore, MD (US); Timothy P. Conroy, Annapolis, MD (US)

(73) Assignee: POLY-PLANAR GROUP, LLC, Hanover, MD (US)

( * ) Notice: Subject to any disclaimer, the term of this patent is extended or adjusted under 35 U.S.C. 154(b) by 0 days.

(21) Appl. No.: 15/260,254

(22) Filed: Sep. 8, 2016

(65) Prior Publication Data

US 2018/0070159 A1 Mar. 8, 2018

(51) Int. Cl.
*H04R 1/02* (2006.01)

(52) U.S. Cl.
CPC ..... *H04R 1/026* (2013.01); *H04R 1/028* (2013.01)

(58) Field of Classification Search
CPC ..... A41D 1/005; H04R 1/026; H04R 1/025; B60R 11/0217
USPC ..... 181/149, 150, 151, 206; 367/89; 381/334, 386, 387, 189, 389, 391, 412; 442/338; 340/425.5
See application file for complete search history.

(56) References Cited

U.S. PATENT DOCUMENTS 3,987,258 A * 10/1976 Tsutsui ..... H04R 1/021 181/149
3,989,909 A * 11/1976 Hodsdon ..... H04R 1/023 181/175
4,575,882 A * 3/1986 Diamond ..... A47K 3/001 4/559
4,965,837 A 10/1990 Murayama et al.
5,022,341 A * 6/1991 Eveanowsky, Jr. ..... B60Q 5/00 116/142 FP
5,306,880 A * 4/1994 Coziar ..... H04R 1/345 181/149
5,451,726 A * 9/1995 Haugum ..... H04R 1/345 181/150
5,458,958 A * 10/1995 Kanzaki ..... B32B 5/26 428/310.5
5,550,334 A * 8/1996 Langley ..... F16L 55/0333 181/206
5,866,858 A * 2/1999 Dewey ..... H04R 1/02 181/151
6,457,547 B2 10/2002 Novitschitsch
7,840,021 B2 * 11/2010 Greco ..... H04R 1/023 181/175
8,265,320 B2 9/2012 Datz et al.
9,615,155 B2 * 4/2017 Yoshida ..... H04R 1/025
2004/0037445 A1 * 2/2004 Kirihara ..... B60R 11/0217 381/389

(Continued)

*Primary Examiner* — Gerald Gauthier
(74) *Attorney, Agent, or Firm* — Knobbe Martens Olson & Bear, LLP

(57) ABSTRACT

A self-draining speaker assembly for draining a liquid is disclosed. The speaker assembly includes a frame having a cover member and a chassis member configured to receive the cover member. The cover member includes one or more openings. The chassis member includes a drain. An audio driver is supported by the frame and has a cone portion. The one or more openings, the cone portion, and the drain are disposed relative to each other so that a liquid entering the speaker assembly through the cover member exits the speaker assembly through the drain.

20 Claims, 8 Drawing Sheets

(56) References Cited

U.S. PATENT DOCUMENTS

| | | | | |
|---|---|---|---|---|
| 2008/0095395 | A1* | 4/2008 | Pieklik | H04R 1/028 381/387 |
| 2008/0298175 | A1* | 12/2008 | LaWhite | G01S 15/885 367/89 |
| 2009/0190787 | A1* | 7/2009 | Pieklik | H04R 1/023 381/386 |
| 2010/0046785 | A1* | 2/2010 | Schmidt | H04R 1/025 381/387 |
| 2012/0182137 | A1* | 7/2012 | Nakayama | B60Q 5/008 340/425.5 |
| 2012/0321121 | A1 | 12/2012 | Taylor et al. | |
| 2013/0329929 | A1* | 12/2013 | Yoshida | H04R 1/02 381/334 |
| 2014/0119592 | A1* | 5/2014 | Choi | H04R 9/06 381/412 |
| 2014/0270304 | A1* | 9/2014 | Pieklik | H04R 1/023 381/334 |
| 2015/0195635 | A1* | 7/2015 | Garfio | H04R 1/02 381/386 |
| 2016/0270454 | A1* | 9/2016 | Gehlen | A41D 1/005 |
| 2018/0009392 | A1* | 1/2018 | Yokota | B60R 11/0217 |

* cited by examiner

SPEAKER ASSEMBLY

BACKGROUND

Field of the Disclosure

The present application relates generally to a speaker (or "loudspeaker"), and more particularly to a self-draining speaker.

Background of the Disclosure

Music is an increasing part of everyday life. Many people enjoy listening to music everywhere they go, including while in hot tubs, spas (portable or otherwise), bathrooms, pools, and other similar recreational and therapeutic locations. For these purposes, speakers, and the like, are often installed near water sources (e.g., shelves of spas) or in locations exposed to moisture, liquids, and other elements. However, mounting the speakers in close proximity to water within the spa exposes the speakers to chemicals, moisture, and other detrimental elements that can degrade the speaker materials. For example, ozone, chlorine, bromine and other chemical vapors can be present in high concentrations in the gas zone between liquid level and inside of the cover of a spa, where the speakers may be positioned. Such chemical concentrations in the gas zone can be higher than the concentrations of such chemicals in the water. Thus, improved speakers to be placed within proximity to water and other liquids are desired.

SUMMARY

Embodiments disclosed herein relate to, for example, speakers that are mountable to a spa. Any of the features, components, or details of any of the arrangements or embodiments disclosed in this application, including those disclosed below, are interchangeably combinable with any other features, components, or details of any of the arrangements or embodiments disclosed herein to form new arrangements and embodiments. Without limiting the scope of this disclosure, its more prominent features will now be briefly discussed. After considering this discussion, and particularly after reading the section entitled "Detailed Description of Certain Embodiments," one will understand how the features of the embodiments described herein provide advantages over existing speakers.

The speaker embodiments disclosed herein can be configured such that a liquid that enters a speaker drains through the speaker without damaging the speaker. For example, when speakers are mounted in spas or in walls of other objects, water from spas, pools, the sea, or otherwise, as well as other liquids, can collect inside the speaker. Such liquid collection can damage the speaker, as discussed above.

As will be described, embodiments of the speaker assembly overcome these problems by draining a liquid that contacts the speaker assembly through and out of the speaker assembly. In some embodiments, as will be described, a chassis member attached to a cover member can form a frame member around an audio driver structure that houses one or more audio drivers. In some embodiments, the speaker assembly is configured such that a liquid that contacts the speaker assembly passes through the cover member to the audio driver structure via one or more openings in the cover member. In some embodiments, the liquid may then pass through the audio driver structure to the chassis member via a cone portion of the audio driver structure. In some embodiments, the liquid may then pass through the chassis member and out of the speaker assembly or into a mounting member via an opening defined within a base portion of the chassis member. As such, the speaker assembly can drain a liquid through and out of the speaker assembly without damaging the speaker.

One aspect of the present application provides a self-draining speaker assembly having a frame including a cover member and a chassis member configured to receive the cover member. The cover member comprises one or more openings. The chassis member comprises a drain. The speaker assembly further includes an audio driver supported by the frame and having a cone portion. The one or more openings, the cone portion, and the drain are disposed relative to each other so that a liquid entering the speaker assembly through the cover member exits the speaker assembly through the drain.

Another aspect of the present application provides self-draining speaker that includes a chassis member comprising a drain and an audio driver supported by the chassis member and having a cone portion. The cone portion has an opening configured to receive at least a portion of the drain so that a liquid entering the audio driver exits the speaker through the drain.

Another aspect of the present application is method of draining a liquid from a speaker assembly that includes a cover member and a chassis member configured to receive the cover member. The method includes flowing the liquid through one or more openings in the cover member and to an audio driver, the audio driver having a cone portion, flowing the liquid across the cone portion and towards a drain in the chassis member, and flowing the liquid through the drain and out of the speaker assembly.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The following are brief descriptions of the drawings.

DETAILED DESCRIPTION OF CERTAIN EMBODIMENTS

The following detailed description is directed to certain specific features of the embodiments of a speaker apparatus.

In this description, reference is made to the drawings wherein like parts are designated with like numerals throughout the description and the drawings. Also, although the term "spa" is used throughout this description, it is to be understood that the present invention is applicable to a spa, spa enclosure, spa shelf, hot tub, hot tub enclosure, pool, bathroom, and other fluid bearing recreational, therapeutic, or water or other liquid proximal surfaces or otherwise. Accordingly, as used herein, the term "spa" is to be understood to mean all such fluid bearing recreational or therapeutic devices, as well as the other objects listed above.

Although particular aspects are described herein, many variations and permutations of these aspects fall within the scope of the disclosure. Although some benefits and advantages of the preferred aspects are mentioned, the scope of the disclosure is not intended to be limited to particular benefits, uses, or objectives. Rather, aspects of the disclosure are intended to be broadly applicable to different system configurations, some of which are stated by way of example in the following description of the preferred aspects. The detailed description and drawings are merely illustrative of the disclosure rather than limiting, the scope of the disclosure being defined by the appended claims and equivalents thereof.

Further, it should be readily apparent to one of ordinary skill in the art that, for any speaker apparatus embodiments disclosed herein, such embodiments are not limited to use with a spa. Any speaker enclosure embodiments disclosed herein can be mounted on any surface of any desired object, and oriented in any direction, where the user desires an audio speaker system such as, but not limited to, tables, counter-tops, work benches, desks, walls, and other desired surfaces inside or outside of a user's home, boat, car, or other vehicle, recreational or otherwise.

Figure 1:
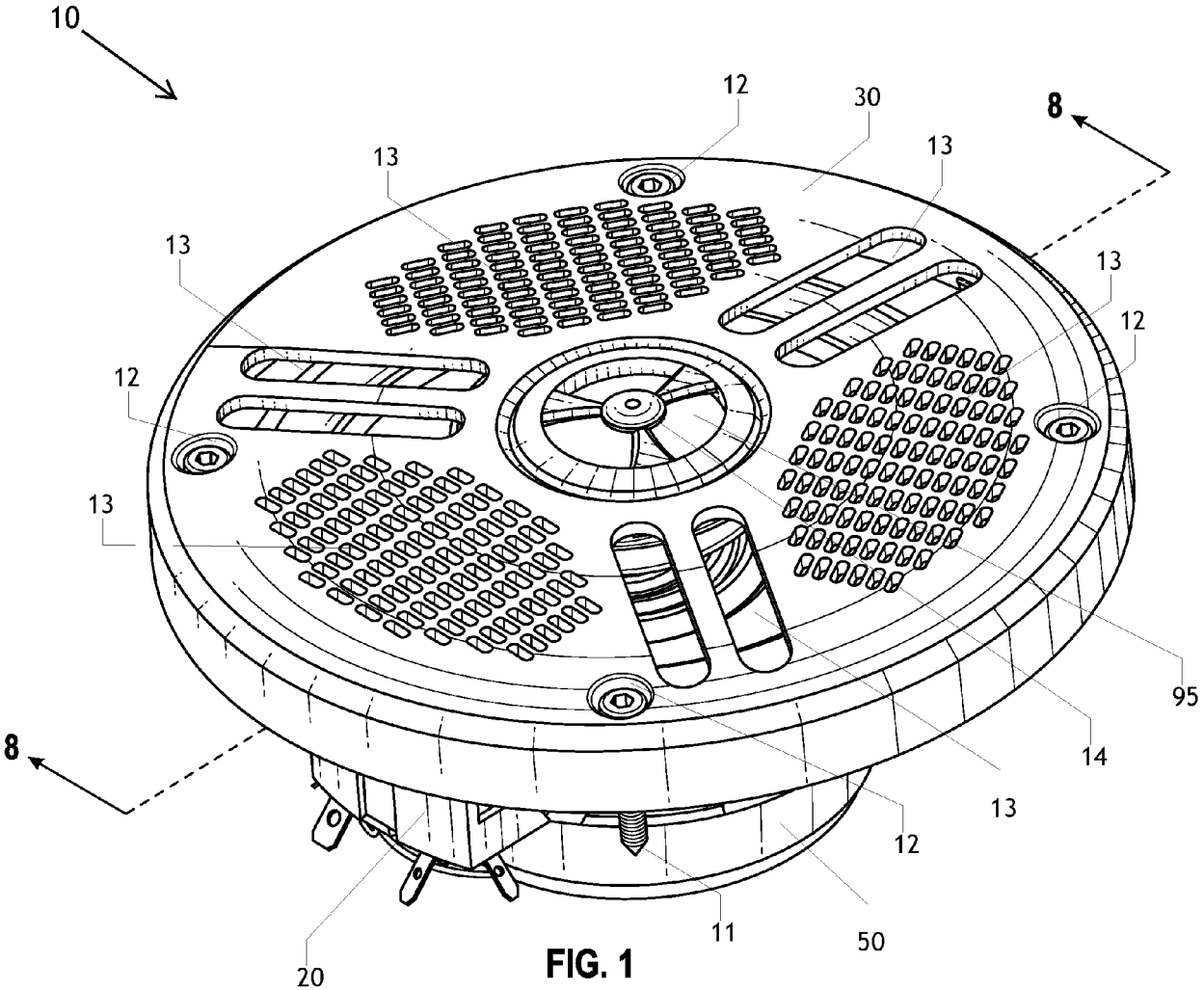
FIG. 1 is an isometric illustration of a speaker assembly in accordance with a preferred embodiment of the present invention.

FIG. 1 is an isometric illustration of an embodiment of a speaker assembly 10, or enclosure, which can include a cover 30 and a chassis 50. The cover 30 may be a ring shape or other shape. The cover 30 can include one or more holes 12, one or more vents 13, and/or a center piece 14. As further described below, a liquid (e.g., water) that contacts the speaker assembly 10 may enter the cover 30 and pass through to an audio driver structure 70 via the one or more vents 13, the center piece 14, and/or other openings of the cover 30. The vents 13 may be of a different pattern and/or quantity than that as illustrated in FIG. 1. The center piece 14 may have a different pattern or shape than that as illustrated in FIG. 1. In an embodiment, a high cone 95 included on the audio driver structure 70 (see FIG. 6) may be situated underneath the center piece 14 such that water pools up and flows out over into, for example, the vents 13. In other embodiments, the high cone 95 may include a drain hole disposed at a base of the high cone 95 that allows water to flow through to the audio driver structure 70. The high cone 95 is further illustrated in connection with FIG. 6.

Figure 5:
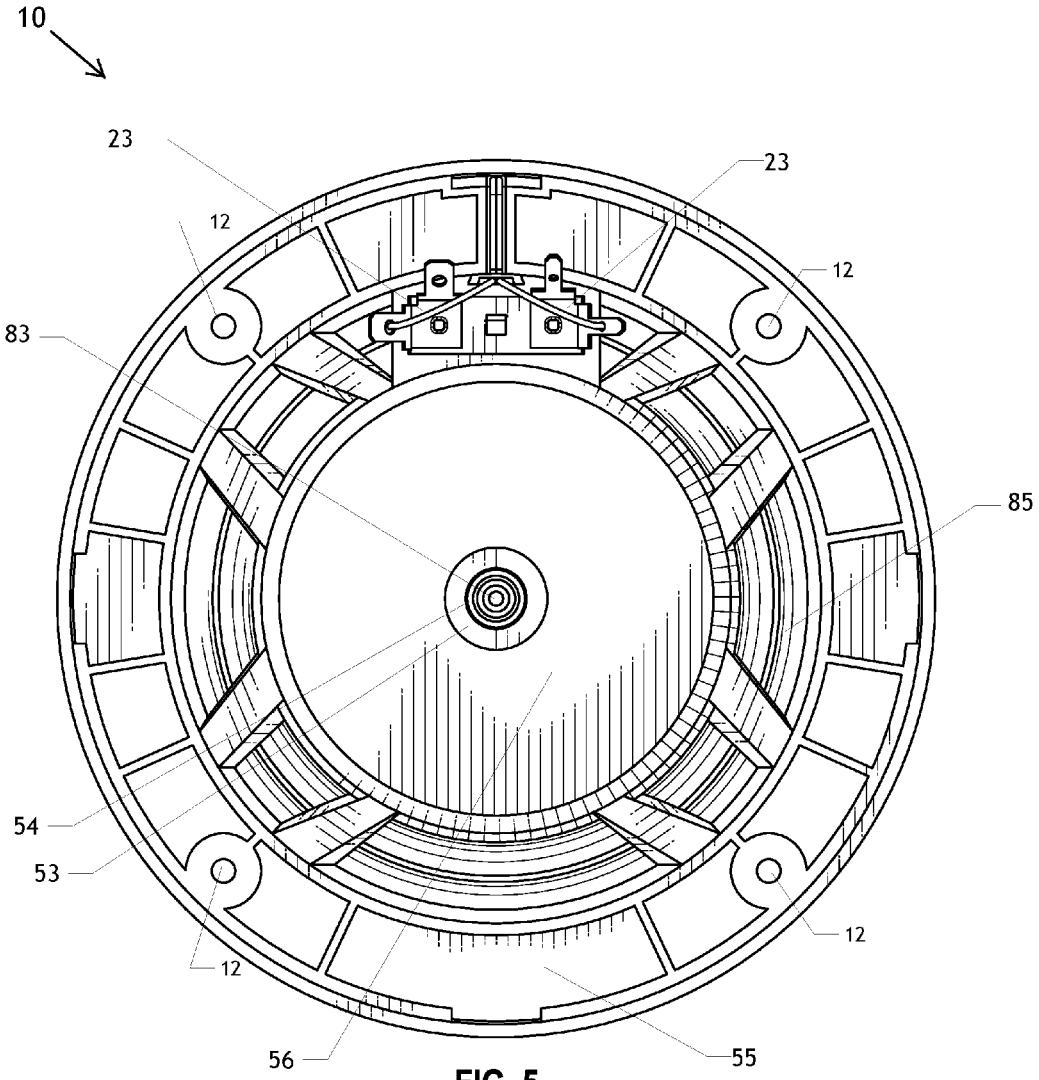
FIG. 5 is a bottom view of the speaker assembly illustrated in FIG. 1.
Figure 6:
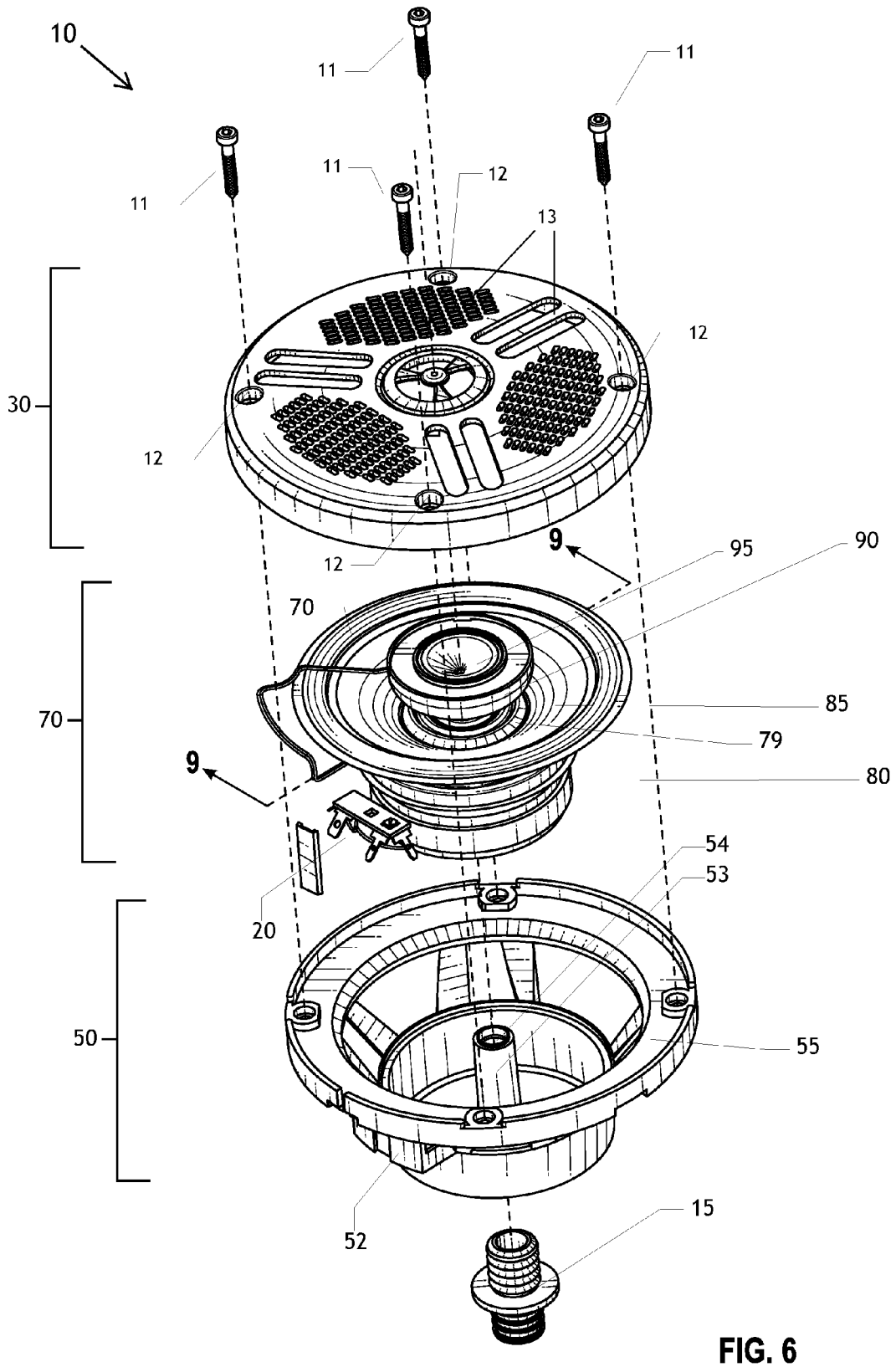
FIG. 6 is an isometric, exploded view of the speaker assembly illustrated in FIG. 1.
Figure 7:
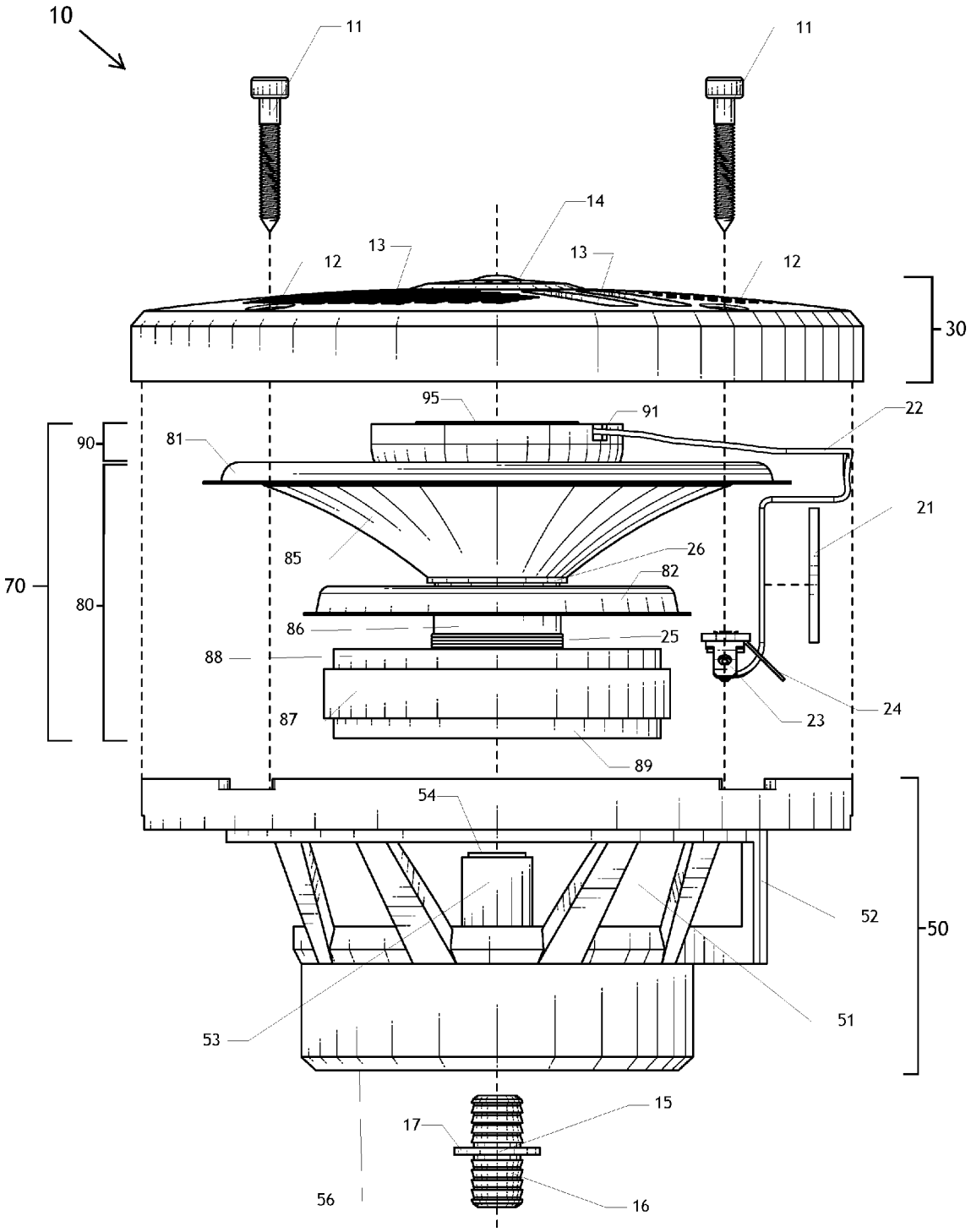
FIG. 7 is a side, exploded view of the speaker assembly illustrated in FIG. 1.

The cover 30 and the chassis 50 can be attached to form a frame (e.g., a speaker frame or enclosure) around the audio driver structure 70 including a signal network 20, which are further described with respect to FIGS. 6 and 7. The cover 30 may be attached to the chassis 50 via one or more screws 11 inserted through one or more holes 12 and into a low flange portion 55 included on the chassis 50, as further described below with respect to FIGS. 5-7. Cross-section indicator 8 illustrates the direction of the cross-section for the view illustrated in FIG. 8 below.

The cover 30 and/or the chassis 50 may be made of a plastic material (e.g., molded plastic) or any other suitable material. As further described below, one or more components of the audio driver structure 70 (e.g., one or more audio driver units and/or their components thereto) may be attached and/or included on or within the cover 30, the chassis 50, or both. The one or more screws 11 may be threaded screws, socket-head capped screws, and/or any other suitable screw or fastener capable of attaching the cover 30 and the chassis 50 together in connection with the one or more holes 12 and/or other suitable openings of the cover 30. In some aspects, if a mounting panel (not pictured) is too thin, metal fasteners (e.g., screw clips) can be used in connection with the screws 11 so as to secure the speaker assembly 10.

In some aspects, the cover 30 may also be referred to as "grill," "cover member," "frame," "frame member," "plastic ring," etc. In some aspects, the chassis 50 may also be referred to as "frame member," "frame," "magnet structure," "basket," etc. In some aspects, the vents 13 may also be referred to as "vents," "holes," etc. In some aspects, the center piece 14 may also be referred to as "grill center," "center hole," "center cone," "cone," "high cone," "vent," "drain," "pool," etc.

Figure 2:
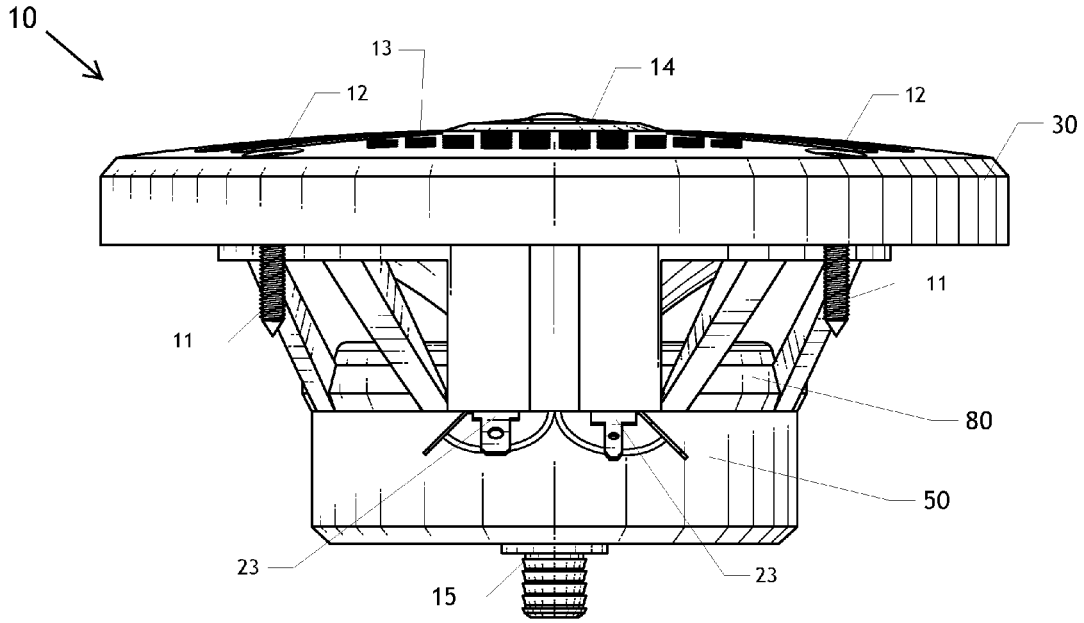
FIG. 2 is a side view of the speaker assembly illustrated in FIG. 1, taken from a first angle.

FIG. 2 is a side view of the speaker assembly 10 illustrated in FIG. 1, taken from a first angle. As illustrated, the audio driver structure 70 may include a low frequency driver structure 80, as further described with respect to FIGS. 6 and 7. In some embodiments, the low frequency driver structure 80 can house and/or comprise one or more components of a subwoofer, woofer, and/or other audio drivers for transmitting low frequency audio signals. As further described below, the audio driver structure 70 may include terminals 23 in connection with the signal network 20. The terminals 23 can be metal, e.g., copper. In some aspects, the terminals 23 may also be referred to as "tags," "electrical connection," "source," "audio source," "connection," etc. As described above, the speaker assembly 10 may be mounted to a wall, floor, or otherwise. To that end, the speaker assembly 10 may include a mounting member 15, as further described below.

Figure 3:
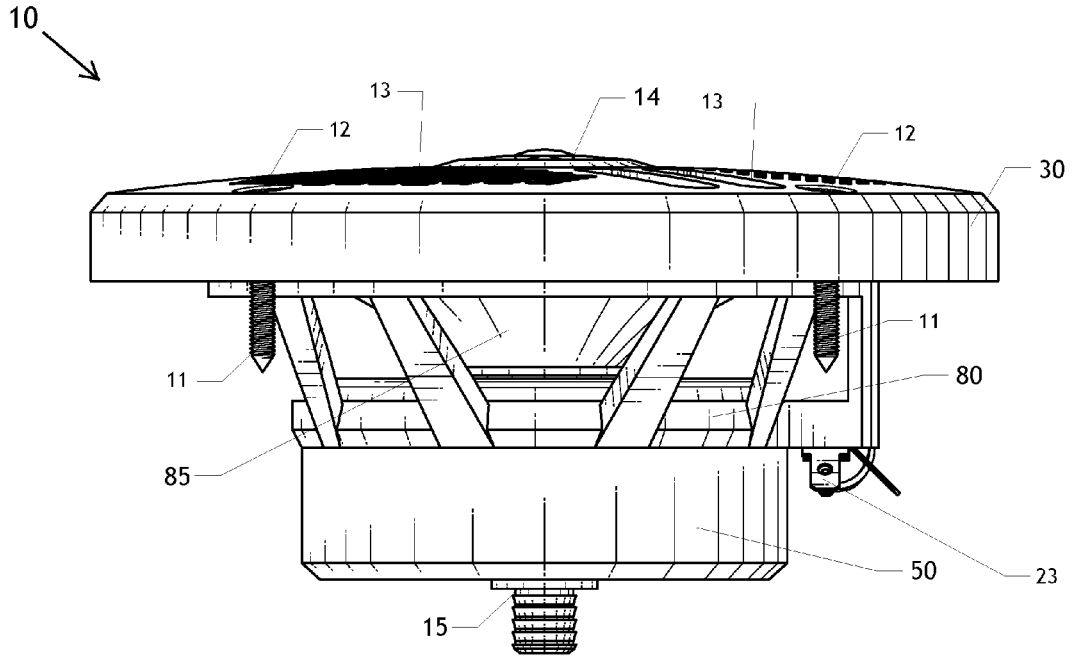
FIG. 3 is a side view of the speaker assembly illustrated in FIG. 1, taken from a second angle that is offset from the first angle by 90 degrees.
Figure 4:
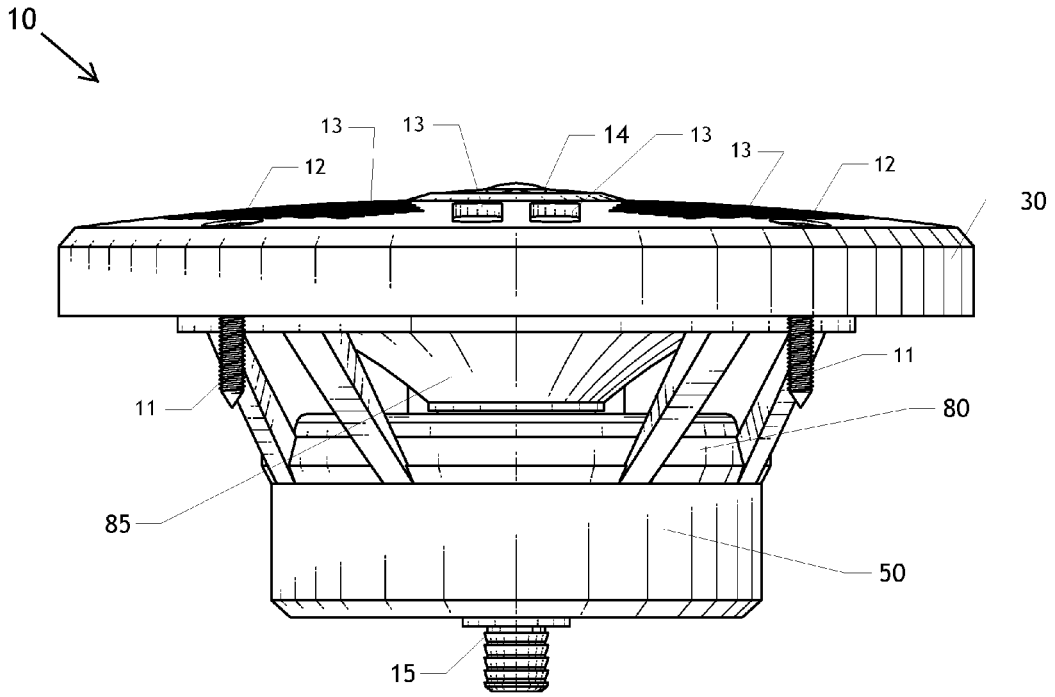
FIG. 4 is a side view of the speaker assembly illustrated in FIG. 1, taken from a third angle that is offset from the first angle by 180 degrees.

FIG. 3 is a side view of the speaker assembly 10 illustrated in FIG. 1, taken from a second angle that is offset from the first angle by 90 degrees. FIG. 4 is a side view of the speaker assembly 10 illustrated in FIG. 1, taken from a third angle that is offset from the first angle by 180 degrees. As illustrated, the low frequency driver structure 80 may include a low cone 85, as further described with respect to FIGS. 6 and 7. As further described with respect to FIGS. 6 and 7, in an embodiment, the low cone 85 may be situated underneath the cover 30 so as to receive water drained through one or more of the vents 13, the center piece 14, and/or the high cone 95. In an embodiment, the low cone 85 may include a drain hole that allows water to flow through to the chassis 50, as further described below. In some aspects, the low cone 85 may also be referred to as "drain," "diaphragm," etc.

FIG. 5 is a bottom view of the speaker assembly 10 illustrated in FIG. 1. As illustrated, the chassis 50 may include a base 56, which may comprise an "underside" or "bottom" of the chassis 50. The base 56 may also be referred to as "base portion." The chassis 50 may include a pole 53 that protrudes vertically to connect with one or more aspects of the audio driver structure 70, as further described in connection with FIGS. 6 and 7. A drain 54 may be defined within the base 56 (e.g., within the pole 53), for example, such that water drained from the low cone 85 may pass through the base 56 via the drain 54, as further described below. In some aspects, the drain 54 may also be referred to as "tube," "opening," "hole," etc. As will be further described in connection with FIGS. 6 and 7, a dust cap cover 83 may be situated directly on top of the drain 54 and in the center of the low cone 85. In an aspect, the dust cap cover 83 may be dome-shaped and fit within a hole of a dust cap 79 (or "dome") of the low frequency driver structure 80, as described and illustrated in connection with FIGS. 6-8. In an aspect, the dust cap cover 83 can include one or more holes such that water from the low cone 85 may pass through the hole of the dust cap 79 and into the drain 54. In some aspects, the dust cap cover 83 may also be referred to as "screen cover," "vent cover," "hole cover," "gap cover," "drain cover," etc.

In some aspects, product specifications for the speaker assembly 10 (e.g., on a sticker) may be included on the base 56. For example, product specifications illustrated on the base 56 may include one or more of a distributing company name and contact information, a model number, a product name, a maximum power for the speaker assembly 10 (e.g., 60 watts), an impedance of the speaker assembly 10 (e.g., 4 ohms), a country of manufacture, among other product specifications. In other embodiments, product specifications may be included on other aspects of the speaker assembly 10 or may not be included at all.

Figure 9:
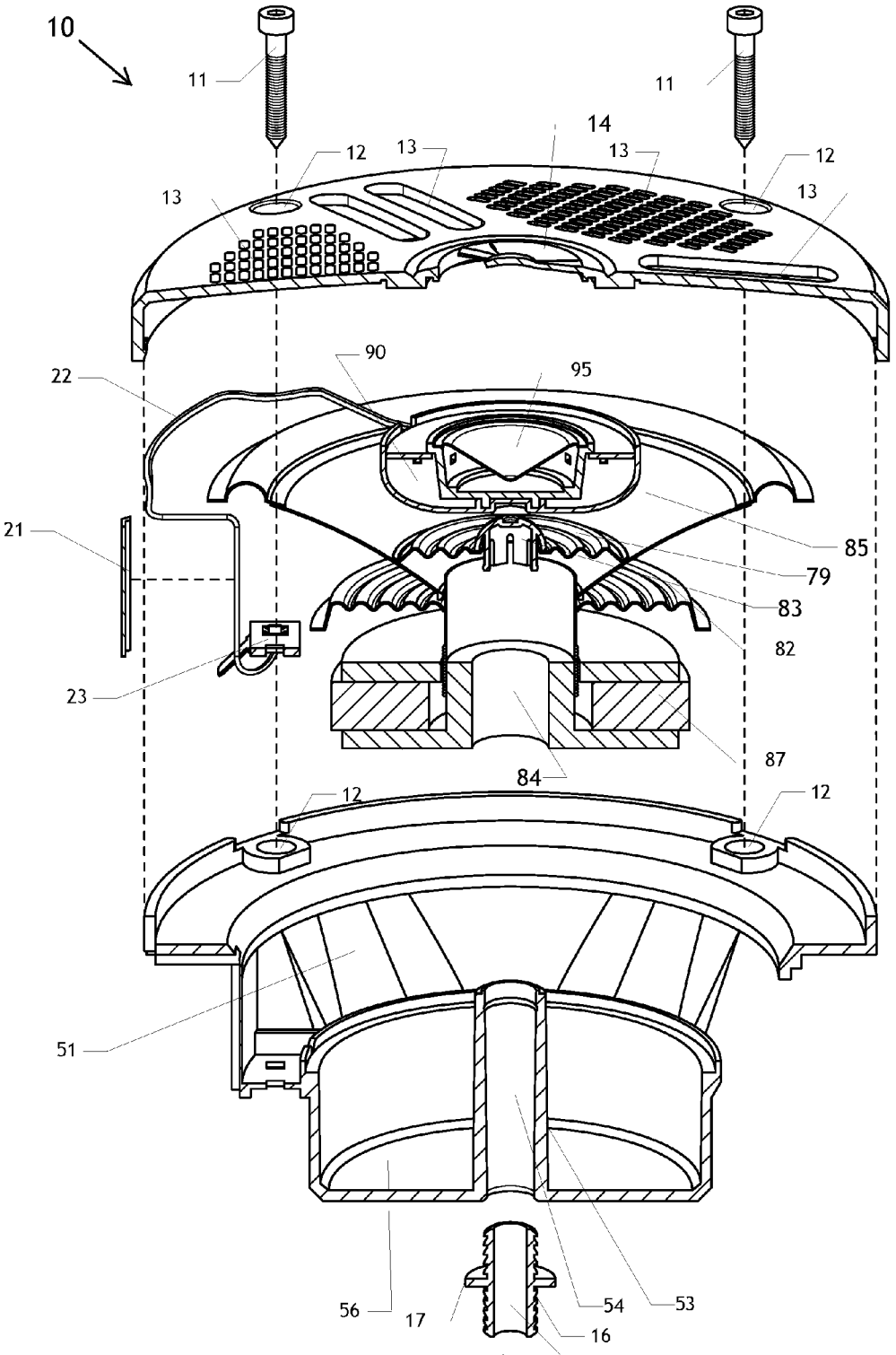
FIG. 9 is an exploded isometric section view of the speaker assembly illustrated in FIG. 1.

FIG. 6 is an isometric, exploded view of the speaker assembly 10 illustrated in FIG. 1. As illustrated, the chassis 50 can include a housing 52 for housing one or more components of the signal network 20, as further described in connection with FIG. 7. In some aspects, the housing 52 may also be referred to as "terminal housing," etc. In some embodiments, in addition to or instead of the low frequency driver structure 80, the audio driver structure 70 may include a high frequency driver structure 90, as further described with respect to FIG. 7. In some embodiments, the high frequency driver structure 90 can house and/or comprise one or more components of a tweeter (e.g., a piezoelectric tweeter) and/or other audio drivers for transmitting high frequency audio signals. For example, the speaker assembly 10 may comprise a two-way audio driver system comprising a low-frequency audio driver unit (e.g., the low frequency driver structure 80) and a high-frequency audio driver unit (e.g., the high frequency driver structure 90). In one example, the two-way audio driver system may provide stereophonic sound. Cross-section indicator 9 illustrates the direction of the cross-section for the view illustrated in FIG. 9 below.

FIG. 7 is a side, exploded view of the speaker assembly 10 illustrated in FIG. 1. As illustrated, the chassis 50 can include ventilation gaps 51, which can provide airflow for the audio driver structure 70. The ventilation gaps 51 can include openings in the chassis 50, arranged as illustrated in FIG. 7, or in some other size and arrangement. For example, as illustrated, the ventilation gaps 51 may resemble and be arranged similar to an "open back" for a low-frequency audio driver (e.g., the low frequency driver structure 80), as further described below. In some aspects, the ventilation gaps 51 may also be referred to as "airflow," "system cooling," "open back," etc.

As described above, the speaker assembly 10 may be mounted to a wall, floor, or otherwise, and to that end, the speaker assembly 10 can include the mounting member 15. As illustrated, the mounting member 15 can comprise a washer 17 surrounding an insert 16, or bushing, to facilitate mounting the speaker assembly 10. The insert 16 can be externally threaded, interiorly threaded, both, or neither. An opening can be defined within the insert 16 to allow water, for example, to drain through the drain 54 of the base 56 and then through the opening of the insert 16. As one example, mounting specifications for the speaker assembly 10 may include one or more of an outer mounting hole diameter (e.g., 5.83 inches), a mounting depth (e.g., 2.77 inches), a minimum installation depth (e.g., 2.56 inches), and an assembly weight (e.g., 1.15 pounds). The speaker assembly 10 can drain water as described herein whether mounted or unmounted.

As illustrated, the low frequency driver structure 80 can further include a surround 81, a constraining member 82, a cylinder 86, a magnet 87, a top plate 88, a bottom plate 89, among other components. The surround 81 can comprise or resemble a low-frequency audio driver surround, e.g., a woofer surround. For example, the surround 81 may be rubber, ring-shaped, and support the front of the low cone 85. The surround 81 may be attached (e.g., via adhesive) to the chassis 50 at the low flange portion 55. The bottom plate 89 may rest in the chassis 50 on the opposite side of the base 56. The magnet 87, the top plate 88, and the bottom plate 89 may comprise or resemble a low-frequency audio driver magnet, top plate, and bottom plate, respectively. As one example, the magnet 87 may comprise a 5.3 ounce driver magnet. The top plate 88 may also be referred to as "washer," "front plate," etc. The bottom plate 89 may also be referred to as "back plate," etc.

The cylinder 86 can comprise or resemble a low-frequency audio driver voice coil or "former." For example, the cylinder 86 may be surrounded by a ring 26 and windings 25, which, in connection with the signal network 20, can create movement within the low frequency driver structure 80, making sound. Further aspects with respect to the signal network 20, the ring 26, and the windings 25 are described below.

The constraining member 82 can comprise or resemble a low-frequency audio driver assembly (or "spider"). For example, the constraining member 82, together with the surround 81, can function as a low-frequency audio driver "suspension" and constrain, or dampen, the cylinder 86 such that it moves axially without touching the constraining member 82. The constraining member 82 may surround the cylinder 86 and be situated under the ring 26 and above the windings 25, as described below.

As discussed above, the audio driver structure 70 can include the signal network 20, which can include one or more of a wire cover 21, one or more lead wires 22, the terminals 23, an input 24, the windings 25, the ring 26, among other components (e.g., binding posts, spring clips, panel-mount jacks, etc.). The components of the signal network 20 can be configured to function together to establish an electrical connection for transmitting audio signals from the input 24 to one or more components of the speaker assembly 10 (e.g., one or more audio drivers). For example, the input 24 may be connected to an audio source device (not pictured), such as one or more audio amplifiers, a crossover, a stereo, or any other audio source device, that transmits audio signals to the speaker assembly 10 via the input 24. In some embodiments, the signal network 20 may include one or more audio amplifiers (not pictured), for example, inside of a protective enclosure in connection with a circuit board discussed below, in proximity to the input 24, and in proximity to the low frequency driver structure 80, among other locations. In some embodiments, the signal network 20 may not include an audio amplifier.

The input 24 may electrically connect to the terminals 23, where the signal network 20 may be configured to transmit the audio signals to one or more audio drivers housed within the speaker assembly 10, e.g., to the low frequency driver structure 80 and/or the high frequency driver structure 90 of the audio driver structure 70. For example, the audio signals may be transmitted to the windings 25 and the ring 26 so as to move the cylinder 86 of the low frequency driver structure 80. As another example, the audio signals may be transmitted to a power coil (not pictured) of the high frequency driver structure 90. The audio signals can be transmitted to the one or more audio drivers via the one or more lead wires 22. In some aspects, the high frequency driver structure 90 can include lead openings 91 such that the lead wires 22 may reach the power coil of the high frequency driver structure 90. The wire cover 21, which can fit into a slot of the housing 52, can cover and/or protect one or more of the lead wires 22. The terminals 23 can be mounted to the housing 52, for example, via soldering.

In some embodiments, the signal network 20 may include a crossover (not pictured) for separating the audio signal into two or more frequency ranges so as to maintain the integrity of one or more of the audio drivers and/or the quality of their audio output. For example, the crossover may separate the audio signal into a low frequency range suitable for a low-frequency audio driver (e.g., the low frequency driver structure 80) and a high frequency range suitable for a high-frequency audio driver (e.g., the high frequency driver structure 90). One having ordinary skill in the art will understand that a crossover can include any number of specifications and configurations for separating the audio signal and transmitting the separated audio signals to one or more of the respective audio drivers.

In one of many configurations, the signal network 20 may not include the crossover described above. For example, the audio signal may pass through an external crossover prior to being received at the input 24. Under such conditions, the signal network 20 may include additional inputs 24 (not pictured) and circuitry (not pictured) configured to transmit the separated audio signals to the corresponding audio drivers. As another example, if the audio driver structure 70 includes a single audio driver unit (e.g., the low frequency driver structure 80, the high frequency driver structure 90, or a different audio driver), the signal network 20 may transmit the full frequency range of the audio signal to the single audio driver unit. As another example, if the high frequency driver structure 90 comprises a piezoelectric tweeter (e.g., a 1.25 inch piezo tweeter), the signal network 20 may transmit the full frequency range of the audio signal to the high frequency driver structure 90, relying on the capacitive properties of the piezoelectric tweeter to maintain the integrity of the high frequency driver structure 90. One having ordinary skill in the art will understand that other scenarios and conditions exist wherein the signal network 20 may not include a crossover. One having ordinary skill in the art will also understand that the signal network 20 may still include a crossover even under the above scenarios and conditions described.

In one embodiment, the audio driver structure 70 may further comprise a protective enclosure (not pictured) that surrounds the high frequency driver structure 90 and protects the high frequency driver structure 90 from, for example, water. In one aspect, the protective enclosure may be one or more of: dome-shaped, transparent, plastic, etc. In such embodiments, the speaker assembly 10 may further comprise a circuit board (not pictured) enclosed within the protective enclosure. The circuit board may be in proximity to or attached to the high frequency driver structure 90. For example, the circuit board may be cut into a ring such that the circuit board fits within the protective enclosure and fits around the high frequency driver structure 90. The circuit board may include any number of electrical components (e.g., transistors, resistors, light-emitting diodes (LEDs), capacitors, inductors, etc.) configured to respond to the audio signal. As one example, the circuit board may include one or more LEDs and suitable corresponding components (e.g., one or more resistors), such that the LEDs emit light in synchronization with the audio signal.

In some embodiments including the protective enclosure, the protective enclosure may be sealed to the cover 30, for example, via an adhesive, via fasteners of the cover 30 (not pictured), and/or via fasteners of the protective enclosure. In such embodiments, the lead wire 22 may be threaded along the inside of the cover 30, through an opening in the protective enclosure, along the circuit board (if present), and then through the lead openings 91.

Figure 8:
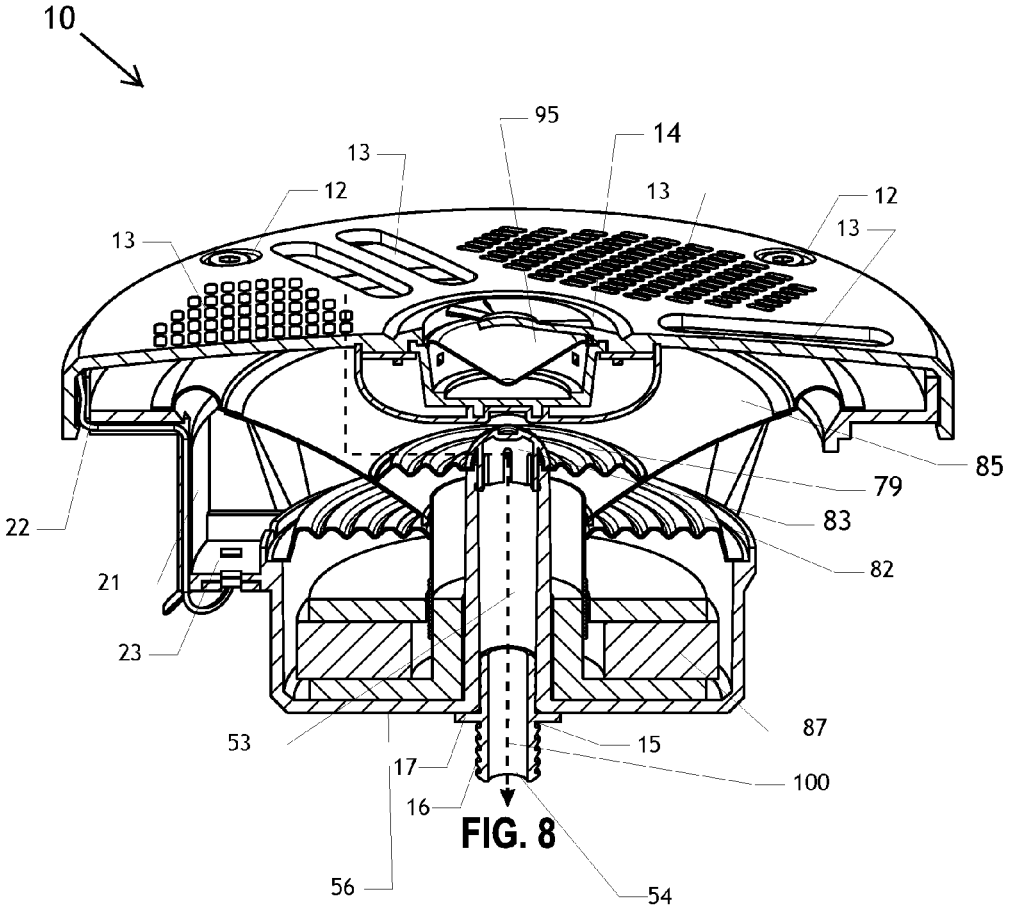
FIG. 8 is an isometric section view of the speaker assembly illustrated in FIG. 1.

FIGS. 8 are 9 are an isometric section view and an exploded isometric section view of the speaker assembly 10 illustrated in FIG. 1, respectively. As described above, the low frequency driver structure 80 can include the dust cap cover 83. As illustrated, the dust cap cover 83 can be located within a center of the low cone 85 and inserted so as to fill an opening formed in the center of the dust cap 79. To allow the drain 54 to fit through the low frequency driver structure 80, a center pole 84 can be formed as an opening through the center of the magnet 87, the top plate 88, and the bottom plate 89. The center pole 84 can function similar to a center pole of a low-frequency audio driver.

An exemplary flow path 100 through the speaker assembly 10 is illustrated in FIG. 8. At least portions of the flow path 100 can be followed by a liquid that has entered the speaker assembly 10 to exit the speaker assembly 10. Thus, depending on where the liquid enters the speaker assembly 10 (e.g., cover 30, vents 13, center piece 14, etc.), the fluid may follow all or only a portion of the flow path 100 to exit the speaker assembly 10.

The flow path 100 in FIG. 8 begins with the liquid passing through the vents 13 in the cover 30 and flowing along a surface of the low cone 85 and across a surface of the dust cap 79 before entering the drain 54 via an opening in the dust cap cover 83. Of course the described path is only exemplary of the flow path 100 through the speaker assembly 10 and variations on the flow path 100 that may be longer or shorter than the illustrated flow path 100 are within the disclosure. Thus, the components of the speaker assembly 10 can be rearranged, removed, rotated, etc. while still providing the flow path 100 through the speaker assembly 10. Further, in certain embodiments, the angle of surfaces of, for example, the low cone 85 is selected so that the speaker assembly 10 drains liquid regardless of mounting angle of the speaker assembly 10.

Any of the components of the speaker assembly 10 can be formed from any suitable materials, including corrosion protected metals, plastics and rubbers such as ethylene propylene diene monomer (EPDM), ABS plastic, Acrylonitrile Styrene Acrylate (ASA) plastic, and otherwise. Additionally, any of the parts disclosed herein can be formed using any suitable processes, including injection molding and otherwise.

As mentioned, the speaker apparatuses described herein are preferably configured to be mounted to any surface of a bathtub, pool, spa, or other water-containing object, water vehicle, or with proximity to any liquid in any desired position. Additionally, a plurality of speaker apparatuses can be used simultaneously, as well as other audio speaker components such as a receiver, music compact disc player, DVD player, subwoofer speaker system, n-way (e.g., two-way, three-way, etc.) driver systems, full-range drivers, subwoofers, woofers, mid-range drivers, tweeters, coaxial loudspeakers, etc.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments can be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims.

It is to be understood that the claims are not limited to the precise configuration and components illustrated above. Various modifications, changes, and variations may be made in the arrangement, operation, and details of the aspects described above without departing from the scope of the claims.

While the foregoing is directed to aspects of the present disclosure, other and further aspects of the disclosure may be devised without departing from the basic scope thereof, and the scope thereof is determined by the claims that follow.

What is claimed is:

1. A self-draining speaker assembly comprising:

a frame including a cover member and a chassis member configured to receive the cover member, the cover member comprising one or more openings, the chassis member comprising a drain; and an audio driver supported by the frame and having a cone portion and a drain hole in flow communication with the drain, the drain hole being disposed in the cone portion, wherein the one or more openings, the cone portion, and the drain are disposed relative to each other so that a liquid entering the speaker assembly through the cover member passes through the drain hole and exits the speaker assembly through the drain.

2. The speaker assembly of claim 1, further comprising a dust cap disposed within the audio driver and configured so that the liquid flows from the cone portion to the drain via the dust cap, the drain hole being disposed in the dust cap.

3. The speaker assembly of claim 2, further comprising a dust cap cover disposed in the dust cap and configured so that the liquid flows from the dust cap to the drain via the dust cap cover, the drain hole being disposed in the dust cap cover.

4. The speaker assembly of claim 3, wherein the drain hole comprises one or more openings, the one or more openings being configured so that the liquid flows through the one or more openings before entering the drain.

5. The speaker assembly of claim 1, wherein the chassis member further comprises a flange portion and a base portion, the flange portion being configured to support the cover member at least when the cover member is disposed on the chassis member.

6. The speaker assembly of claim 1, wherein the audio driver is a low frequency audio driver, and wherein the cone portion is attached to the low-frequency audio driver.

7. The speaker assembly of claim 1, further comprising a second audio driver supported by the cover, the second audio driver having a second cone portion sized and shaped to flow the liquid into the one or more openings of the cover member.

8. The speaker assembly of claim 7, wherein the second audio driver comprises a high-frequency audio driver, and wherein the second cone portion is attached to the high-frequency audio driver.

9. The speaker assembly of claim 1, wherein the speaker assembly is configured to be horizontal when the liquid entering the speaker assembly through the cover member exits the speaker assembly through the drain.

10. The speaker assembly of claim 1, wherein the speaker assembly is configured to be mounted at any angle that is between zero degrees and ninety degrees relative to horizontal when the liquid entering the speaker assembly through the cover member exits the speaker assembly through the drain.

11. The speaker assembly of claim 1, further comprising a mounting member including an opening, wherein at least a portion of the mounting member is configured to support the chassis member so that the opening is in flow communication with the drain.

12. A self-draining speaker comprising:

a chassis member comprising a drain; and an audio driver supported by the chassis member and having a cone portion and a drain hole in flow communication with the drain, the drain hole being disposed in the cone portion and being configured to receive at least a portion of the drain so that a liquid entering the audio driver flows on a surface of the cone portion into the drain hole and exits the speaker through the drain.

13. The speaker of claim 12, further comprising a cover member configured to be supported by the chassis member, the cover member having one or more openings disposed over the cone portion when the chassis member is supporting the cover member.

14. The speaker of claim 13, wherein the chassis member further comprises a flange portion and a base portion, the flange portion being configured to support the cover member at least when the cover member is disposed on the chassis member.

15. The speaker of claim 12 further comprising a dust cap disposed within the audio driver and configured so that the liquid flows from the cone portion to the drain via the dust cap, the drain hole being disposed in the dust cap.

16. The speaker of claim 15, further comprising a dust cap cover disposed in the dust cap and configured so that the liquid flows from the dust cap to the drain via the dust cap cover, the drain hole being disposed in the dust cap cover.

17. The speaker of claim 16, wherein the drain hole comprises one or more openings, the one or more openings being configured so that the liquid flows through the one or more openings before entering the drain.

18. The speaker of claim 12, wherein the drain and the drain hole are located at a center of the cone portion.

19. A method of draining a liquid from a speaker assembly comprising a cover member and a chassis member configured to receive the cover member, the method comprising:

flowing the liquid through one or more openings in the cover member and onto a surface of a cone portion of an audio driver, the cone portion comprising a drain hole;

flowing the liquid across the cone portion, towards the drain hole, and into a drain in the chassis member, the drain being in flow communication with the drain hole; and flowing the liquid through the drain and out of the speaker assembly.

20. The method of claim 19, wherein the speaker assembly further comprises a mounting member including an opening defined within the mounting member, the method further comprising:

attaching the speaker assembly to a spa; and inserting the mounting member into the drain such that the liquid is configured to flow from the drain and into the opening in the mounting member and into the spa.

* * * * *